United States Patent [19]

Weindanz et al.

[11] 4,303,160

[45] Dec. 1, 1981

[54] PACKAGE FOR SINGLE FILM STACK

[75] Inventors: Herbert Weindanz, Odenthal; Horst Auf dem Graben, Cologne, both of Fed. Rep. of Germany

[73] Assignee: N.V. Optische Industrie "De Oude Delft", Delft, Netherlands

[21] Appl. No.: 922,012

[22] Filed: Jul. 5, 1978

[30] Foreign Application Priority Data

Jul. 8, 1977 [DE] Fed. Rep. of Germany ..... 2730881

[51] Int. Cl.[3] ..... B65D 85/00; B65D 85/30; B65D 85/62

[52] U.S. Cl. ..... 206/455

[58] Field of Search ..... 206/449, 555, 454, 455, 206/456, 438, 439, 440, 441, 484, 484.1, 484.2

[56] References Cited

U.S. PATENT DOCUMENTS

| | | | |
|---|---|---|---|
| 2,084,296 | 6/1937 | Eustis | 206/484.1 |
| 2,310,371 | 2/1943 | Lings et al. | 206/455 |
| 3,184,121 | 5/1965 | Volckening | 206/484 |
| 3,958,693 | 5/1976 | Greene | 206/455 |
| 3,986,609 | 10/1976 | Marsh et al. | 206/455 |
| 4,158,409 | 6/1979 | Duinker | 206/455 |

FOREIGN PATENT DOCUMENTS

| | | | |
|---|---|---|---|
| 1076834 | 3/1960 | Fed. Rep. of Germany | 206/455 |

*Primary Examiner*—Joseph Man-Fu Moy

[57] ABSTRACT

A package which loads a stack of single films into an internally bladed daylight cassette, has a waisted middle part accommodating the stack, a strip for retaining the package in the cassette, a transverse weld following the retaining strip, a pull tab for pulling the package out of the cassette, a transverse weld in the pull tab and a pair of longitudinal welds in the upper and lower side of the pull tab with widened portions in the zone where the cassette blades enter, which welds continue to the transverse weld.

12 Claims, 4 Drawing Figures

PACKAGE FOR SINGLE FILM STACK

The invention relates to a package for a stack of rectangular single films having a retaining strip, a transverse weld following the retaining strip, a waisted middle part accommodating the stack a pull tab adjoining the middle part and a transverse weld in the pull tab. The basic film package of this type is shown and described in U.S. Pat. No. 4,158,409 of the same assignee, which issued Jun. 19, 1979.

BACKGROUND OF THE INVENTION

This package is adapted to be drawn by hand out of a cassette which permits daylight loading, by pulling upon a pull tab. According to the temperament, skill and strength of the operator it is possible to pull the package improperly. For example it is possible to pull the tab too quickly or in the wrong direction. Moreover, pulling requires free space for the pulling hand. Since the daylight cassette is flanged attached to the actual camera, pulling also stresses the flange construction, the camera and the cassette.

Moreover in the package according to the basic copending patent, the problem of light-tightness at the moment of closure of the cassette arises. When the blades which are fitted on the upper part of the cassette penetrate into the pull tab, the cassette is not yet fully closed, that is, the cassette is not yet light-tight. Nevertheless the package is already partly cut.

Finally with respect to such packages it should be noted that some firms prefer vacuum packages while other firms prefer packages in the interior of which normal atmospheric pressure prevails.

OBJECTIVES AND STATEMENT OF THE INVENTION

It is the objectives of the invention to provide a package which is suitable both for production with normal atmospheric pressure and with vacuum pressure, which can be drawn out of the daylight cassette either by hand or by motor, and which avoids the problems of light-tightness associated with the closing of the cassette.

In accordance with the invention this problem is solved in that the upper side and the under side of the pull tab are connected by a weld in that zone in which the blade of the cassette pierces the pull tab and in that the weld is continued as a longitudinal weld at least to the next transverse weld.

Due to these measures the package remains light-tight until the cassette is closed. The longitudinal welds connect the upper and lower sides of the pull tab so that the upper side cannot precede or lag behind the under side in motor extraction by rolls, especially if one of these rolls in undriven. For this reason therefore there are no bulges in the pull tab. Furthermore the longitudinal weld introduces a force into the package exactly in the direction in which the blade offers resistance. This leads to a smoother blade cut without lateral tearing or corrugations.

In the present invention, the air space in the pull tab is in communication with the air space of the middle part. In extraction, no air cushions form, such as occurred every time between the numerous transverse welds in the pull tab in the copending basic patent. Moreover, the number of the welds naturally is also reduced.

Therefore, even though it is better, the package according to the invention is cheaper than that according to the basic patent. Two longitudinal welds in the pull tab are adapted for cassettes having two cutting blades.

By this feature the object is achieved that the advantages according to the invention can be utilised even when the cassette has two blades.

The longitudinal welds pass at one end into the transverse weld at the end of the pull tab. The feature achieves the object that the end edge of the pull tab is stiffened, becomes resistant to pulling, does not open like a paper bag, permits good introduction of the forces and in the case of continuous production forms a good cutting zone from the adjoining retaining strip. Moreover then cushion-shaped inclusions are not formed, which would be the case if one were to provide two transverse welds.

A widened portion is in the longitudinal weld at its end in the zone where the blade is intended to pierce, and the weld is narrower than the widened portion in its other portions. The feature acheives the object that the longitudinal welds can be kept as narrow as necessary for the introduction and transmission of forces and the pull tab is not unnecessarily stiffened, which would be unfavourable if one must turn the pull tab around rolls in extraction.

The longitudinal weld is about 5 mm. wide Dimensioning in accordance therewith has proven its value very well in the case of film stacks of 100×100 mm. and 50 single films.

The widened portion is about 8 mm. wide and 6 mm. long. Due to the feature, the widened portions become sufficiently small, but permit sensible tolerances.

The transverse weld is at the end of the pull tab and is about as wide as the retaining strip. The feature achieves approximately equal mechanical stiffness and security against light penetration at both ends of the package. Equal mechanical stiffness permits symmetrical cutting conditions.

The transverse weld has a suspension hole. Due to the feature, unused packages can be stored in an orderly and space-saving manner.

The retaining strip has positioning holes for pegs of the cassette, at different distances from the middle of the package. Due to the feature, the package cannot be inserted into the cassette the wrong way round, since otherwise the pegs do not pass through the positioning holes.

At least the zone around the positioning holes of the retaining strip forms a wide transverse weld. Due to the feature, the positioning holes are embedded in mechanically firm zones.

For packages with atmospheric air pressure in the internal space, a small, easily torn open weld spot approximately centrally and close to the edge of the stack nearest to the pull tab. Due to the feature, it is possible to achieve the object that in such packages the stack of single films remains in its intended position, but nevertheless in drawing out the package, substantially no different forces occur than in the case of vacuum packages.

DESCRIPTION OF THE DRAWING

The invention will now be described with reference to a preferred embodiment. In the drawing.

DETAILED DESCRIPTION OF THE EMBODIMENT

Figure 1:
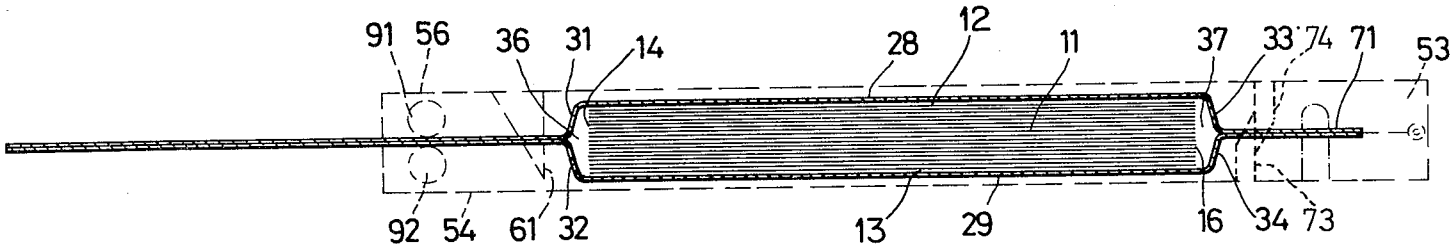
FIG. 1 shows a cross-section through a package with film stack and cassette indicated in dashed lines.

A stack 11 is 100 mm. wide, 100 mm. long and consists of 50 single films the emulsion side of which faces downwards in FIG. 1. The stack 11 has an upper side 12, an under side 13, a left edge 14, a right edge 16, a front edge 17 and a rear edge 18. The stack 11 is of flat rectangular configuration. It consists exclusively of the single films. A wrapper 19 consists of material about 0.1 mm. in thickness which is a polyethylene foil on the inside, an aluminium foil in the middle and a polyester foil on the outside.

Figure 2:
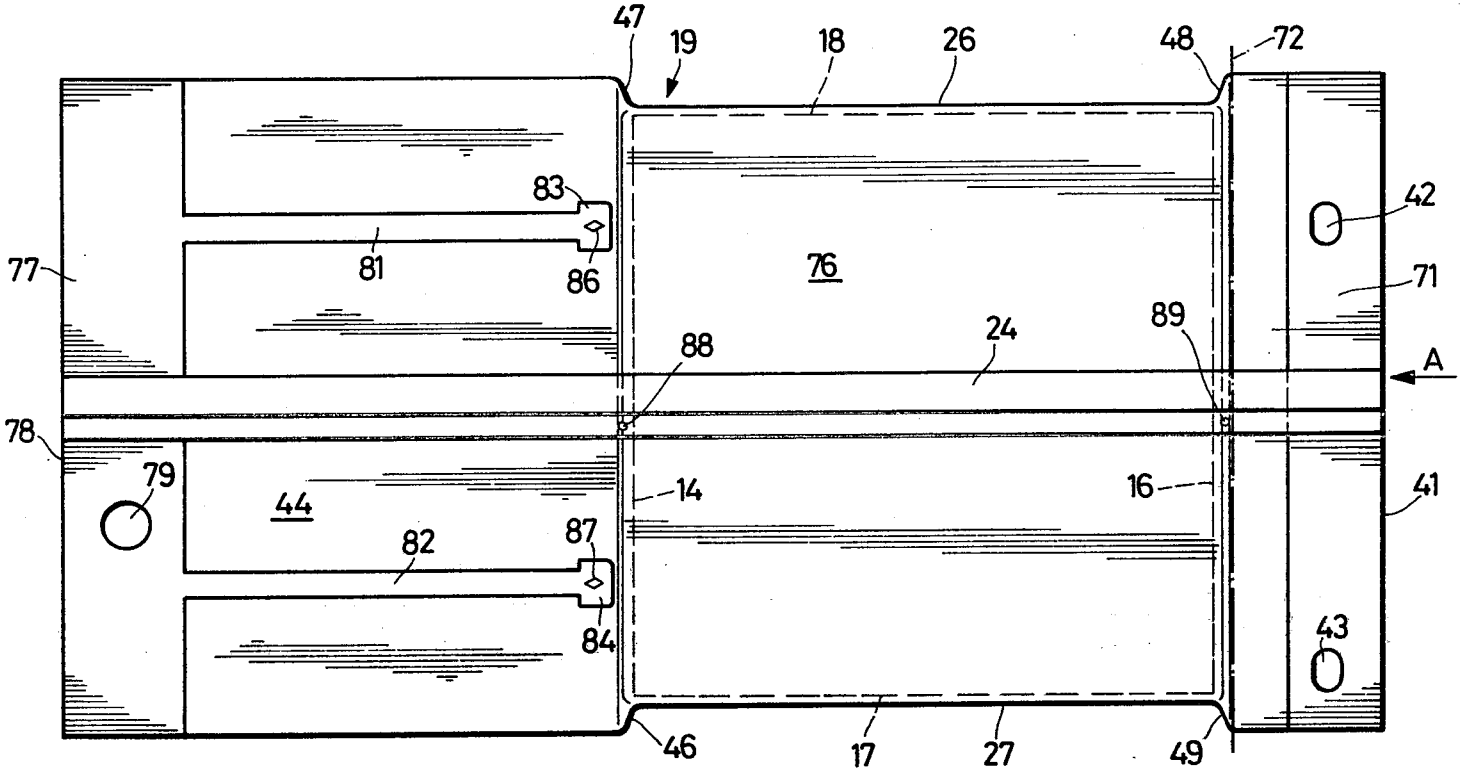
FIG. 2 shows the view of the package from beneath.
Figure 4:
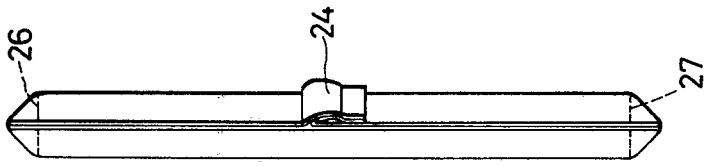
FIG. 4 shows a view in the direction of the arrow A in FIG. 2.
Figure 3:
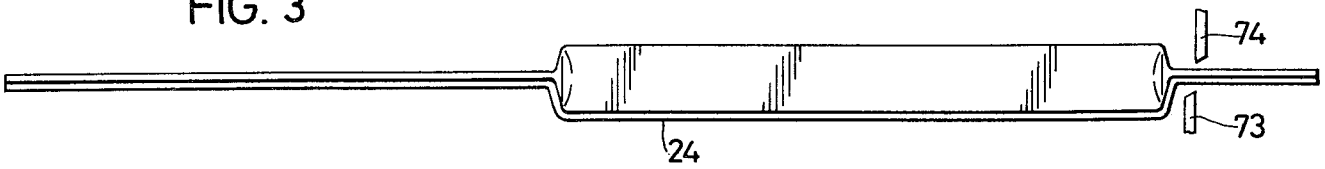
FIG. 3 shows the lateral view of the package with blades indicated.

The wrapper 19 is shaped into a tube by a longitudinal seam 24, which extends over the whole length of the wrapper 19. The wrapper 19 is dimensioned so that in the region of the stack 11 it encloses the latter not quite tautly—unless a vacuum package is concerned—but also not quite so slackly that the stacked orientation of the single films in the stack 11 is lost. Here as in the basic U.S. Pat. No. 4,158,407 there may be seen the longitudinal seam 24, arcs 26, 27 practically straightened in comparison with the basic patent, the upper side 28, the under side 29, the zones 31, 32, 33, 34 sitting more closely than in the basic patent, the cusps 36 and 37, a transverse weld 71 to the right of the cusp 37 in the end zone of the pull tab 44, two holes 42 and 43 in the transverse weld 71, which are formed as slots and lie asymmetically with respect to the geometric longitudinal axis of the package. The dot-and-dash line 72 indicates where one blade 73 meets with another blade 74. The blade 73 is fitted non-displaceably in the under part 54 of the cassette 53 while the blade 74 is fitted in the upper part 56 of the cassette 53, as indicated in FIG. 3. The cushion lobes 47, 48, 46, 49 may also be seen, which however have a more closely fitting course than in the basic patent. It should be expressly indicated that FIGS. 2 to 4 are scale design drawings. To the left of the middle part 76 the pull tab 44 is provided which however, in contrast to the form of embodiment of the parent application, has only on the left outside a transverse weld 77 about 20 mm. in width. As a whole this transverse weld 77 can have 40 mm., so that in continuous production it is possible to cut off or perforate along the right edge 78. A suspension hole 79 is provided in the transverse weld 77.

From the weld 77 two longitudinal welds 81, 82 extend to the right and directly adjoin the transverse weld 77. They are about 55 mm. wide, are arranged symmetrically with respect to the geometric longitudinal axis of the package, and terminate only shortly before the left edge 14. There, the longitudinal welds 81, 82 have widened portions 83, 84. In the widened portions 83, 84 there are indicated lozenges 86, 87 which indicate where the points of the two cutting edges 61 pierce. The centres of the longitudinal welds 81, 82 are aligned with the cutting edges 61.

For non-vacuum-packed packages a small weld spot 88 is provided a short distance from the left edge 14, so that in no case do the cutting edges 61 cut into a single film which may have slipped out to the left from the stack 11. On account of the blades 43, 44, which are formed as transverse cutters, a similar weld spot 89 can be provided a short distance from the right edge 16.

In contrast to the cassette according to the basic patent, this cassette is intended for motorised extraction of the package. For this purpose two rolls 91, 92 are provided of which the lower roll 92 is driven, while the roll 91 merely takes up the counter-pressure. The rolls 91, 92 are merely symbolically illustrated. There may equally be a set having a plurality of rolls, or the rolls can be arranged side by side and not one above the other, to increase the wrap-around angle.

In contrast to the first example of embodiment, the longitudinal seam 24 can lie on the under side of the package.

While the invention is described with reference to 100×100 mm. films, it is also possible for other film formats to be used, for example the X-ray format of 355×425 mm.

What is claimed is:

1. In a package for loading a stack of individual rectangular films into a cassette which has an internal cutter for opening the package transversely to release the film stack within the cassette and at least one internal blade for cutting the package longitudinally to hold the film in the cassette as the opened package is extracted from the cassette, said package having:

a retaining strip, a first transverse weld, a waisted middle part following the first transverse weld for accommodating the film stack, a pull tab having upper and lower sheets, adjoining and following the waisted middle part, and a second transverse weld in the pull tab; the improvement for use with a cassette having a pair of rollers for extracting the package from the cassette after it has been opened, comprising:

at least one longitudinal weld connecting the upper and lower sheets of the pull tab in the zone of the pull tab which is pierced by the longitudinal blade, the longitudinal weld running at least as far as the second transverse weld, and the pull tab forming means drawn between the extraction rollers for extracting the package from the cassette.

2. Package according to claim 1 comprising two longitudinal welds in the pull tab, adapted for cassettes having two cutting blades.

3. Package according to claim 2, in which the longitudinal welds pass at one end into the transverse weld at the end of the pull tab.

4. Package according to claim 1, comprising a widened portion in the longitudinal weld at its end in the zone where the blade is intended to pierce, and is narrower than the widened portion in its other portions.

5. Package according to claim 1, in which the longitudinal weld is about 5 mm. wide.

6. Package according to claim 4, in which the widened portion is about 8 mm. wide and 6 mm. long.

7. Package according to claim 1, in which the transverse weld is at the end of the pull tab and is about as wide as the retaining strip.

8. Package according to claim 7, in which the transverse weld has a suspension hole.

9. Package according to claim 1, in which the retaining strip has positioning holes for pegs of the cassette, at different distances from the middle of the package.

10. Package according to claim 9 in which at least the zone around the positioning holes of the retaining strip forms a wide transverse weld.

11. Package according to claim 1, comprising, for packages with atmospheric air pressure in the internal space, a small, easily torn open weld spot approximately centrally and close to the edge of the stack nearest to the pull tab.

12. Package according to claim 11, in which the transverse weld is about 30 mm. wide.

* * * * *